US005671467A

United States Patent [19]

Katsumata et al.

[11] Patent Number: 5,671,467

[45] Date of Patent: Sep. 23, 1997

[54] COLOR IMAGE-FORMING APPARATUS ADAPTED TO STABILIZE CONTACT BETWEEN ENDLESS BELT-LIKE PHOTOSENSITIVE MEDIUM AND DEVELOPING ROLLER

[75] Inventors: Yoshikazu Katsumata, Fukuoka; Yoshihiro Mizoguchi, Fukuoka-ken; Yoshiaki Ijima, Dazaifu; Makoto Kamioka; Yoshinori Ejima, both of Kasuga; Nobuo Kishiyama, Onojo; Yutaka Noda; Eiichiro Nakao, both of Kurume, all of Japan

[73] Assignee: Matsushita Electric Industrial Co., Ltd., Osaka, Japan

[21] Appl. No.: 571,672

[22] Filed: Dec. 13, 1995

[30] Foreign Application Priority Data

Dec. 28, 1994 [JP] Japan ..... 6-327967

[51] Int. Cl.[6] ..... G03G 15/00

[52] U.S. Cl. ..... 399/164

[58] Field of Search ..... 355/200, 210, 355/211, 212, 213, 326 R, 327, 245, 260; 399/130, 159, 162, 164, 222, 223

[56] References Cited

U.S. PATENT DOCUMENTS

| | | | |
|---|---|---|---|
| 4,984,024 | 1/1991 | Ohkaji et al. | 355/326 R |
| 5,119,147 | 6/1992 | Hays | 355/326 R |
| 5,309,203 | 5/1994 | Hokari | 355/200 X |
| 5,313,259 | 5/1994 | Smith | 355/326 R |
| 5,392,104 | 2/1995 | Johnson | 355/326 R X |
| 5,408,229 | 4/1995 | Haas | 355/327 X |
| 5,493,385 | 2/1996 | Ng | 355/326 R |

FOREIGN PATENT DOCUMENTS 3-241471A 10/1991 Japan .

*Primary Examiner*—Sandra L. Brase

[57] ABSTRACT

A color image-forming apparatus includes an endless belt-like photosensitive member stretched between and wound around a drive roller and a driven roller, and a plurality of developing rollers making contact with an outer surface of the photosensitive member. At least one flexure correction shaft is held in contact with an inner surface of the photosensitive member on the side remote from the developing rollers. With this construction, the condition of contact between each developing roller and the photosensitive member is made stable and uniform, and the developing conditions for all the colors become uniform so that a high-quality image can be obtained.

2 Claims, 4 Drawing Sheets

PRIOR
FIG. 4 ART
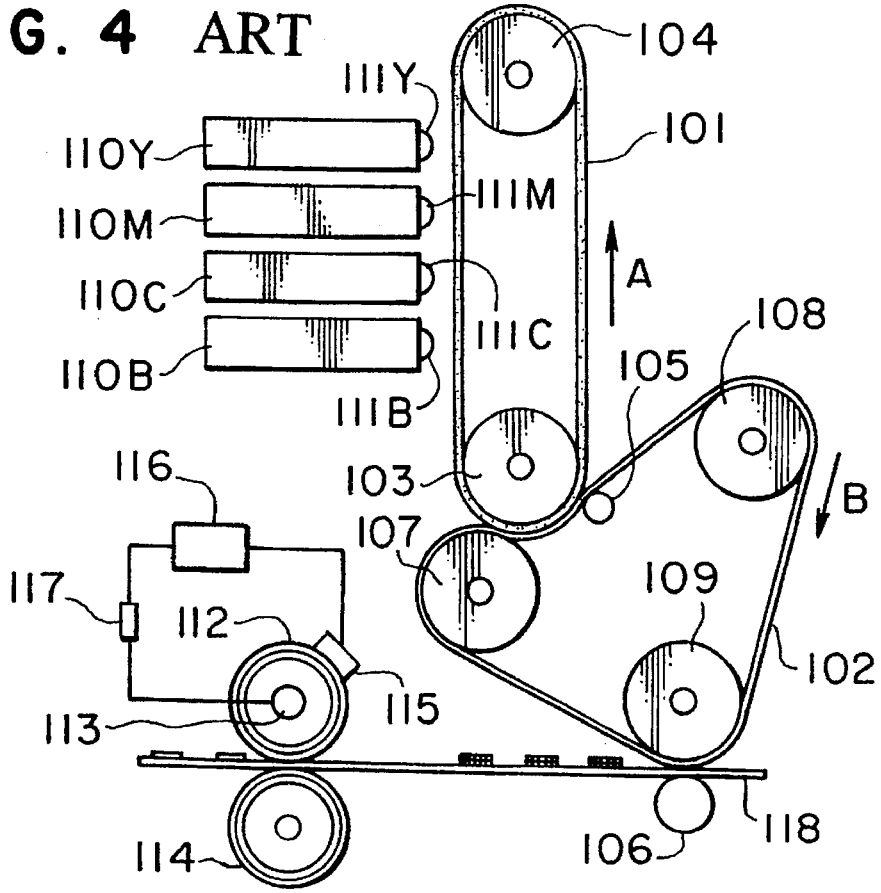
FIG. 5 PRIOR ART
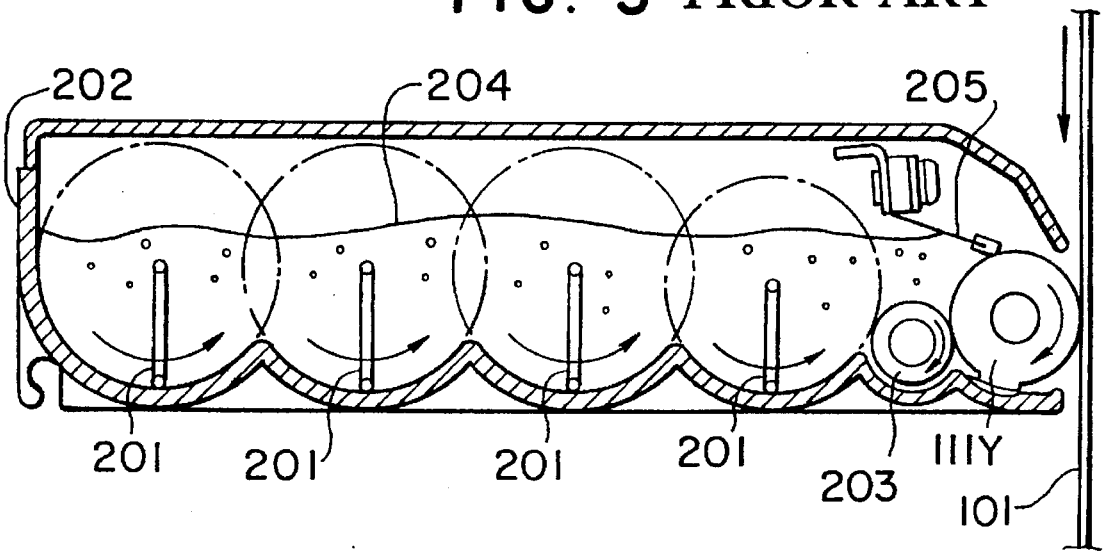

COLOR IMAGE-FORMING APPARATUS ADAPTED TO STABILIZE CONTACT BETWEEN ENDLESS BELT-LIKE PHOTOSENSITIVE MEDIUM AND DEVELOPING ROLLER

BACKGROUND OF THE INVENTION

This invention relates to a color image-forming apparatus using an electrophotographic technique in which an electrostatic latent image, formed on a photosensitive medium, is visualized by toner particles, and is transferred onto paper, and then is fixed to the paper by heat or pressure.

Recently, color image-forming apparatuses have been markedly advanced, and have been widely used as a copier, a laser printer and the like.

A conventional color image-forming apparatus will be described below.

Referring to FIG. 4 which is a view schematically showing the construction of the conventional color image-forming apparatus, a photosensitive member 101 is formed of an endless belt-like base made of polyethylene terephthalate (PET) or the like, and is coated over its outer peripheral surface with a thin layer made of a photosensitive receptive material, such as selenium (Se) or an organic photoconductor (OPC). The photosensitive member 101 is stretched between and wound around a drive roller 103 and a driven roller 104, and is rotated in a direction of the arrow A. An intermediate transfer member 102 in the form of an endless belt is stretched between and wound around a drive roller 107 and driven rollers 108 and 109, and is rotated in a direction of the arrow B. A transfer roller 105 is held against the inner surface of the intermediate transfer member 102, and the surface of the intermediate transfer member 102 is held in contact with the surface of the photo-sensitive member 101 by a pressing force applied by the transfer roller 105. A transfer roller 106 transfers a toner image, formed on the surface of the intermediate transfer member 102, onto printing paper 118. The transfer roller 106 is kept away from the intermediate transfer member 102 when the transfer is not effected. Developing devices 110Y, 110M, 110C and 110B are opposed to the photosensitive member 101, and contain color toners such as yellow toner, magenta toner, cyan toner and black toner, respectively. These developing devices include developing rollers 111Y, 111M, 111C and 111B, respectively, each of which comprises a base or body made of metal such as stainless steel, and a layer of an electrically-conductive material, such as silicone or urethane resin, formed on an outer peripheral surface of the base. A heating roller 112 of metal has a thin layer of silicone rubber or the like coated over its surface, and contains a heater 113 therein. The heating roller 112 is rotatably journalled at its opposite ends, and is driven for rotation by a drive source. A pressure roller 114 made of rubber is coated at its outer peripheral surface with a fluororesin film, and is pressed against the heating roller 112 by an urging member such as a spring. A temperature sensor 115 detects a temperature of the outer peripheral surface of the heating roller 112, and a temperature control portion 116 adjusts a power to the heater 113 in accordance with a detection result of the temperature sensor 115. Reference numeral 117 denotes a heater driver for the heater 113.

FIG. 5 is a view showing the construction of each of the developing devices 110Y, 110M, 110C and 110B of the conventional color image-forming apparatus. The developing devices 110Y, 110M, 110C and 110B have the same construction, and therefore only the developing device 110Y will be described, and explanation of the other developing devices 110M, 110C and 110B will be omitted.

In FIG. 5, each of toner conveyance members 201 is formed by bending a wire of stainless steel or the like into a rectangular shape, and is rotatably journalled at opposite ends thereof to the inner surface of a developing vat 202. A supply roller 203 is formed of a base of made of stainless steel or the like, and coated over its outer peripheral surface with a layer made of an electrically-conductive material such as a urethane resin. The developing roller 111Y is rotatably journalled at its opposite ends on the inner surface of the developing vat 202, and a toner 204, conveyed by the toner conveyance members 201, is supplied to the surface of the developing roller 111Y. A toner control blade 205 is made of an electrically-conductive material such as silicone and urethane resin. The toner 204 is electrically charged and formed into a thin layer by this toner control blade 205 on the developing roller 111Y. Each of the developing devices 110Y, 110M, 110C and 110B is urged away from the photosensitive member 101 by an urging member such as a spring, and each of the developing rollers 111Y, 111M, 111C and 111B is kept away from the photosensitive member 101 when an electrostatic latent image is not developed with a color toner held in the associated developing device.

The operation of the color image-forming apparatus of the above construction will now be described. When printing starts, a latent image corresponding to a yellow component is first formed on the photosensitive member 101 by an exposure means such as a laser, and the developing device 110Y, containing the yellow toner, is moved toward the photosensitive member 101 by a moving means such as a cam, so that the developing roller 111Y is brought into contact with the photosensitive member 101. The toner 204, contained in the developing device 110Y, is fed to the supply roller 203 by the toner conveyance members 201, and then is supplied onto the surface of the developing roller 111Y. The toner 204 on the developing roller 111Y rotates in a direction of an arrow, and is frictionally electrified or charged by the toner control blade 205 so as to be formed into a thin layer on the developing roller 111Y. The thin layer of the toner 204 is fed to the position of contact between the developing roller 111Y and the photo-sensitive member 101. At this contact position, when a potential difference is applied between the developing roller 111Y and the photo-sensitive member 101, the toner 204 adheres to the latent image, formed on the photo-sensitive member 101, to make this latent image visible as a toner image. The residual toner 204 on the developing roller 111Y, which has not contributed to the developing, is scraped off from this roller 111Y by the supply roller 203, and is returned into the developing vat 202. The toner image thus made visible is transferred to the intermediate transfer member 102 by the transfer roller 105 applied with a voltage. Similarly, magenta, cyan and black toner images are formed on the photosensitive member 101, and are transferred onto the intermediate transfer member 102 so as to be superimposed over the yellow toner image. Thus, a composite toner image is formed on the intermediate transfer member 102. This composite toner image is transferred to the printing paper 118 by the transfer roller 106 applied with voltage. The printing paper 118, having the composite toner image transferred thereto, passes between the heating roller 112 and the pressure roller 114. At this time, the composite toner image is fused by the heating roller 112 whose surface temperature is kept at a predetermined temperature, and at the same time the composite toner image is pressed against the printing paper 118 by the heating roller 112 and the pressure roller 114, and therefore is fixed to the printing paper 118.

In the above-mentioned conventional color image-forming apparatus, however, the condition of flexing of the photosensitive member 101 varies over the distance between the drive roller 103 and the driven roller 104, and because of the arrangement of the developing devices 110Y, 110M, 110C and 110B along the path of the photosensitive member 101, the conditions of contact of the developing rollers 111Y, 111M, 111C and 111B with the photosensitive member 101 are different from one another, so that the developing conditions for different colors are not uniform from one to another. This has resulted in a problem that the thus obtained picture quality has been low. To overcome this problem, there has been proposed a method in which a press-contact member for contact with the developing rollers 111Y, 111M, 111C and 111B is provided through the photosensitive member 101. With this method, however, the developing rollers 111Y, 111M, 111C and 111B are likely to be damaged, and the toner likely to remain between the photosensitive member 101 and the developing rollers 111Y, 111M, 111C and 111B, which also results in a problem that the obtained picture quality is low. Furthermore, the determination of the developing condition for each of the developing devices 110Y, 110M, 110C and 110B greatly increases costs.

SUMMARY OF THE INVENTION

In view of the above-mentioned problems, it is an object of this invention to provide a color image-forming apparatus in which the condition of contact between a photosensitive member and each developing roller is made stable, and a developing condition is rendered uniform for all colors, so that a high-quality image can be obtained.

To this end, according to the present invention, there is provided a color image-forming apparatus comprising: an endless belt-like photosensitive member wound around a plurality of support rollers; a plurality of developing devices making a developing material into contact with an outer surface of said photosensitive member to effect developing; and a support member opposed to a point located between the adjacent developing devices, said support member being laid in parallel with said rollers, and held in contact with an inner surface of said photosensitive member. With this construction, the condition of contact between the developing rollers and the photosensitive member becomes uniform, and the developing conditions for all the colors become constant.

BRIEF DESCRIPTION OF THE DRAWINGS

FIG. 4 is a schematic view illustrating the construction of an essential part a conventional color image-forming apparatus; and FIG. 5 is a view illustrating the construction of an essential part of a developing device of the conventional color image-forming apparatus.

DESCRIPTION OF THE PREFERRED EMBODIMENTS

First Embodiment

A first preferred embodiment of the present invention will now be described with reference to the drawings.

Figure 1:
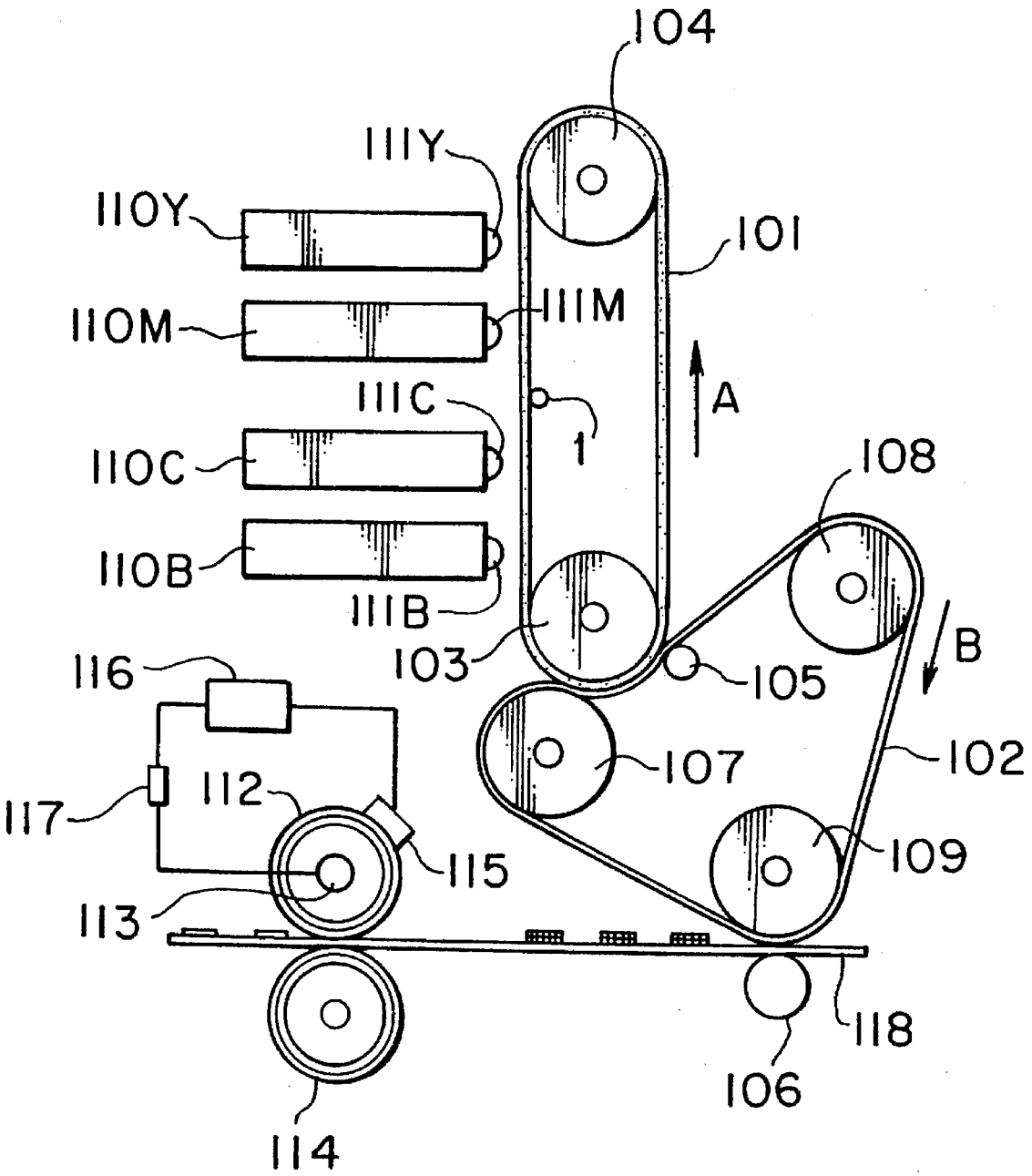
FIG. 1 is a schematic view illustrating the essential part of a color image-forming apparatus in a first embodiment of the invention.

Referring to FIG. 1 which is a view schematically showing a color image forming apparatus in a first embodiment of the present invention, a photo-sensitive member 101 is formed of an endless belt-like base made of polyethylene terephthalate (PET) or the like, and coated over its outer peripheral surface with a thin layer made of a photosensitive receptive material such as selenium (Se) or an organic photoconductor (OPC). The photosensitive member 101 is stretched between and wound around a drive roller 103 and a driven roller 104, and is turned in a direction of the arrow A. An intermediate transfer member 102 in the form of an endless belt wound around a drive roller 107 and driven rollers 108 and 109, and is turned in a direction of arrow B. A transfer roller 105 is held against an inner surface of the intermediate transfer member 102, and the surface of the intermediate transfer member 102 is made into contact with the surface of the photosensitive member 101 by a pressing force applied by the transfer roller 105. A transfer roller 106 transfers a toner image formed on the surface of the intermediate transfer member 102, onto printing paper 118. The transfer roller 106 is kept away from the intermediate transfer member 102 when the transfer is not effected. Developing devices 110Y, 110M, 110C and 110B are opposed to the photosensitive member 101, and contain yellow toner, magenta toner, cyan toner and black toner, respectively. These developing devices include developing rollers 111Y, 111M, 111C and 111B, respectively, each of which is formed of a base or body of metal such as stainless steel, and coated over its outer peripheral surface with a layer of an electrically-conductive material, such as silicone or a urethane resin. Each of the developing devices 110Y, 110M, 110C and 110B is urged away from the photosensitive member 101 by an urging member such as a spring so as to be kept away from the photosensitive member 101 unless an electrostatic latent image is developed by a color toner held therein. A flexure correction shaft 1 is in the form of a bar having a circular cross-section, and is fixedly provided in contact with the inner or rear surface of the photosensitive member 101. With the provision of this flexure correction shaft 1, that side of the photosensitive member 101 facing the developing devices 111 can travel straight in a plane. A heating roller 112 made of metal is coated over its outer peripheral surface with a thin layer of silicone rubber, and contains a heater 113 therein. The heating roller 12 is rotatably journalled at its opposite ends, and is rotated by a drive source. A pressure roller 114 made of rubber is coated at its outer peripheral surface with a thin film made of fluororesin, and is pressed against the heating roller 112 by an urging member such as a spring. A temperature sensor 115 detects the temperature of the surface of the heating roller 112, and a temperature control portion 116 adjusts a power to the heater 113 in accordance with a detection result from the temperature sensor 115. Reference numeral 117 denotes a heater driver for the heater 113.

Figure 2:
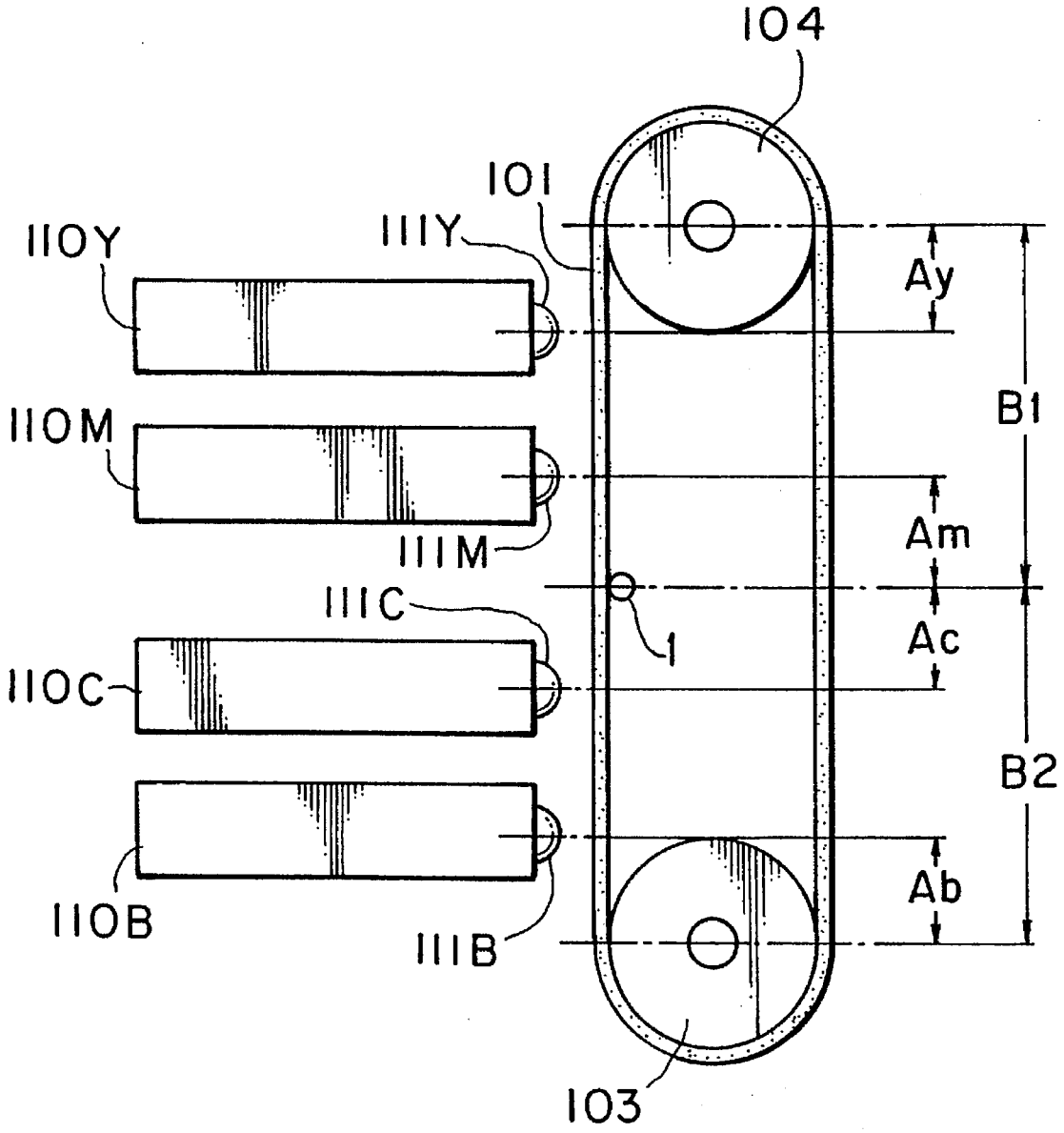
FIG. 2 is a schematic view illustrating essential parts of a photosensitive member and a developing portion in the color image-forming apparatus shown in FIG. 1.

FIG. 2 is a schematic view showing essential parts of the photosensitive member 101 and a developing portion of the color image-forming apparatus in this embodiment. In FIG. 2, the distances between the axes of the drive roller 103, the driven roller 104, the developing rollers 111Y, 111M, 111C and 111B, and the flexure correction roller 1 satisfy the following formulas (1) and (2):

$$Ay=Am=Ac=Ab \quad (1)$$

$$B1=B2 \quad (2)$$

where Ay represents the distance between the axes of the driven roller 104 and the developing roller 111Y in the direction of travel of the belt (photo-sensitive member 101) (In this embodiment, Ay being larger than the radius of the driven roller 104), Am represents the distance between the axes of the developing roller 111M and the flexure correction shaft 1 in the direction of travel of the belt, Ac represents the distance between the axes of the developing roller 111C and the flexure correction shaft 1 in the direction of travel of the belt, and Ab represents the distance between the axes of the developing roller 11B and the drive roller 103 (In this embodiment, Ab is larger than the radius of the drive roller 103). B1 represents the distance between the axes of the flexure correction shaft 1 and the driven roller 104 in the direction of travel of the belt, and B2 represents the distance between the axes of the flexure correction shaft 1 and the drive roller 103 in the direction of travel of the belt.

The operation of the color image-forming apparatus having the above-mentioned construction will now be described. When the printing starts, a latent image corresponding to a yellow component is first formed on the photosensitive member 101 by an exposure means such as a laser, and the developing device 110Y containing the yellow toner, is moved toward the photo-sensitive member 101 by a moving means such as a cam, so that the developing roller 111Y is brought into contact with the photosensitive member 101. The latent image formed on the photosensitive member 101 is developed into a toner image which is then transferred to the intermediate transfer member 102 by the transfer roller 105 applied thereto with a voltage. Similarly, magenta, cyan and black toner images successively formed on the photo-sensitive member 101, are transferred onto the intermediate transfer member 102, being superimposed over the yellow toner image so that a composite toner image is formed on the intermediate transfer member 102. This composite toner image is transferred onto the printing paper 118 by the transfer roller 106 applied with a voltage. The printing paper 118 carrying thereon the composite toner image, passes between the heating roller 112 and the pressure roller 114. At this time, the composite toner image is fused by the heating roller 112 whose surface temperature is kept at a predetermined temperature, and simultaneously the composite toner image is pressed against the printing paper 118 by the heating roller 112 and the pressure roller 114, and therefore is fixed to the printing paper 118. With respect to the developing devices 110Y and 110M, flexure is occurs between and around driven roller 101 and the flexure correction shaft 1 during the developing operation with the driven roller 104 and the flexure correction shaft 1 as fulcrums. However, as indicated in the formula (1). Since the distance Ay between the axes of the driven roller 104 and the developing roller 111Y in the direction of the length of the photosensitive member 101 is equal to the distance Am between the axes of the flexure correction shaft 1 and the developing roller 111M in the direction of the length of the photosensitive member 101, the condition of contact between the developing roller 111Y and the photosensitive member 101 is the same as the condition of contact between the developing roller 111M and the photosensitive member 101. For this same reason, the condition of contact between the developing roller 111C and the photosensitive member 101 is the same as the condition of contact between the developing roller 111B and the photosensitive member 101. Moreover, since the distance B1 between the axes of the flexure correction shaft 1 and the driven roller 104 is equal to the distance B2 between the axes of the flexure correction shaft 1 and the drive roller 103 as indicated in the formula (2), all the developing rollers 111Y, 111M, 111C and 111B can make contact with the photo-sensitive member 101 in the same condition.

As described above, in this embodiment, the drive roller 103, the driven roller 104, the developing rollers 111Y, 111M, 111C and 111B and the flexure correction shaft 1 are so arranged as to satisfy the formulas (1) and (2), and with this construction the condition of contact of the developing rollers 111Y, 111M, 111C and 111B with the photosensitive member 101 is made stable, and the developing conditions for all the colors becomes uniform so that a high-quality image can be obtained.

Second Embodiment

A second preferred embodiment of the invention will now be described with reference to the drawings.

Figure 3:
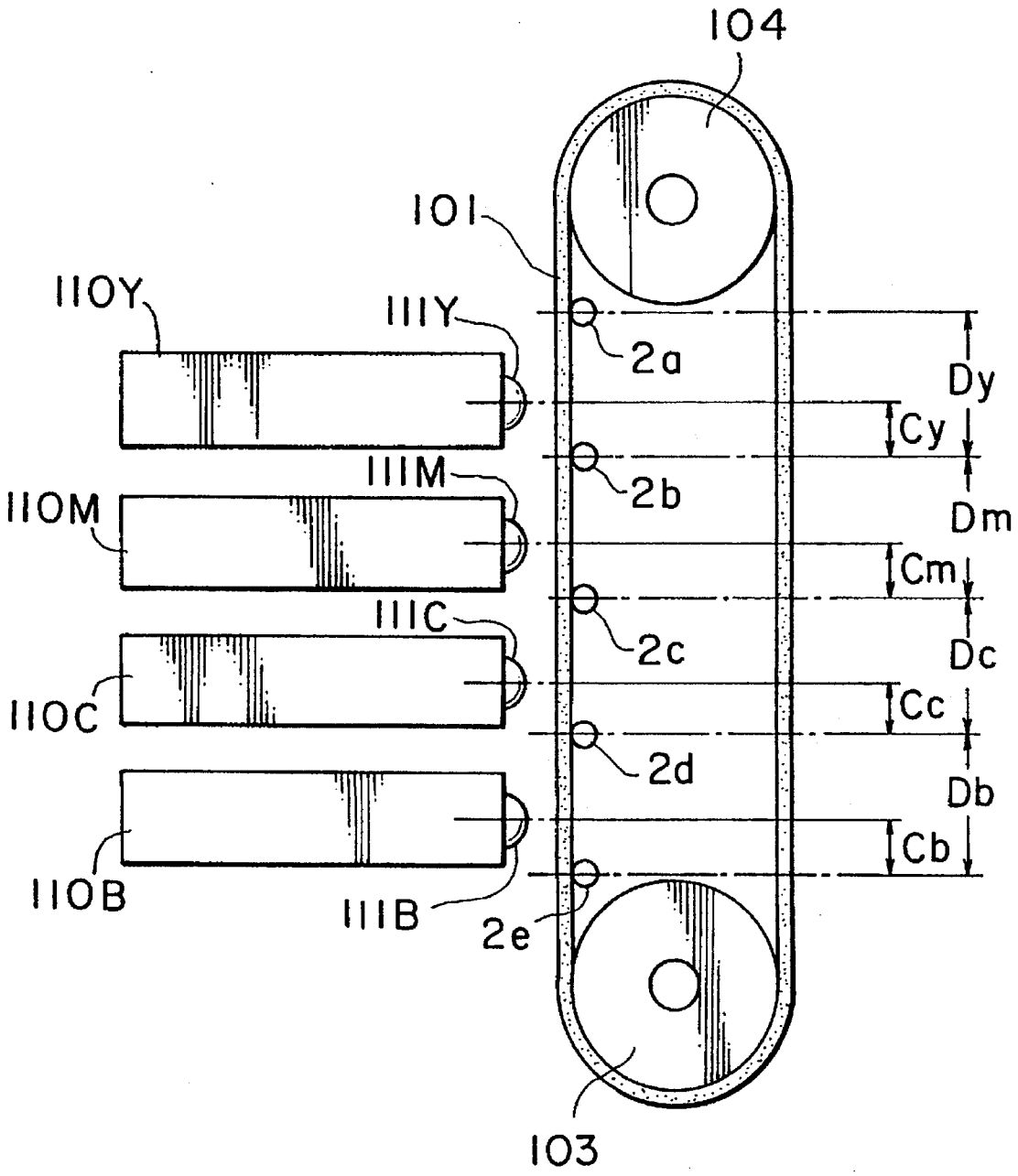
FIG. 3 is a schematic view illustrating essential parts of a photosensitive member and a developing portion in a color image-forming apparatus in a second embodiment of the invention.

Referring to FIG. 3 which is a schematic view showing a photosensitive member 101 of a color image-forming apparatus in the second embodiment, as well as a developing portion thereof. This embodiment differs from the first embodiment shown in FIG. 1 in that a plurality of flexure correction shafts **2*a*, 2*b*, 2*c*, 2*d* and 2*e* are fixedly provided in contact with the inner or rear surface of the photosensitive member 101. The distances between the flexure correction shafts 2*a*, 2*b*, 2*c*, 2*d* and 2*e* and developing rollers 111Y, 111M, 111C and 111B in a direction of the length of the photosensitive member 101** satisfy the following formulas (3) and (4):

$$Cy=Cm=Cc=Cb \quad (3)$$

$$Dy=Dm=Dc=Db \quad (4)$$

where Cy represents the distance between the axes of the developing roller 111Y and the flexure correction shaft **2*b* in the direction of travel of the belt (photosensitive member 101), Cm represents the distance between the axes of the developing roller 111M and the flexure correction shaft 2*c* in the direction of travel of the belt, Cc represents the distance between the axes of the developing roller 111C and the flexure correction shaft 2*d* in the direction of travel of the belt, and Cb represents the distance between the axes of the developing roller 111B and the flexure correction shaft 2*e* in the direction of travel of the belt. Further, Dy represents the distances between the axes of the shafts 2*a* and 2*b*, Dm represents the distance between the shafts 2*b* and 2*c*, Dc represents the distance between the axes of the shafts 2*c* and 2*d*, and Db represents the distance between the axes of the shafts 2*d* and 2*e***.

For example, with respect to the developing device 110Y, flexure is caused by the photosensitive member 101 between and around the adjacent flexure correction shafts **2*a* and 2*b* as fulcrums during developing operation. The flexure correction shafts 2*a* to 2*e*** are spaced therebetween by the same distance, and as is clear from the formulas (3) and (4), the positional relationship between any two adjacent flexure correction shafts and the developing roller disposed therebetween is the same among them all.

As described above, in this embodiment, the developing rollers 111Y, 111M, 111C and 111B and the flexure correction shafts **2*a*, 2*b*, 2*c* and 2*d* are so arranged as to satisfy the above formulas (3) and (4), and with this construction the condition of contact of the developing rollers 111Y, 111M, 111C and 111B with the photosensitive member 101** is made stable, and the developing conditions for all the colors become uniform so that the high-quality image can be obtained.

In the first and second embodiments, although the flexure correction shafts 1 and 2*a* to 2*e* are non-rotatably mounted, these flexure correction shafts may be so mounted as to be rotated about their axis by the moving photosensitive member 101. The flexure correction shafts 1 and 2*a* to 2*e* may take any other suitable shape than that of the shaft. The arrangement of the drive roller 103, the driven roller 104, the plurality of developing devices 110Y, 110M, 110C and 110Y, and the flexure correction shafts 2*a*, 2*b*, 2*c* and 2*d* is not limited to those of the first and second embodiments.

In the first and second embodiment, the elongate photosensitive member 101 is vertically disposed, and the developing rollers 111Y, 111M, 111C and 111B are horizontally brought into contact with the photosensitive member 101; however, the photosensitive member 101 may be disposed vertically, in which case the developing rollers 111Y, 111M, 111C and 111B are vertically brought into contact with the photosensitive member 101 from the upper side or the lower side thereof.

As described above, the apparatus according to the present invention comprises the endless belt-like photosensitive member stretched between and wound around the plurality of rollers, the plurality of developing devices each making the developing material in contact with the surface of the photosensitive member so to effect developing, and the support member(s) which is held in contact with the inner surface of the photo-sensitive member, and which is located between the developing devices. With this construction, the developing devices can make contact with the photosensitive member in a stable and uniform condition, and the developing conditions for all the colors can be uniform so that a high-quality image can be obtained.

What is claimed is:

1. A color image-forming apparatus comprising:

an endless belt-like photosensitive member stretched between and wound around a plurality of support rollers;

four developing devices arranged in a juxtaposed manner to include two adjacent middle developing devices and two opposite outer developing devices along a flat surface portion of said photosensitive member extending between said support rollers, each of said developing devices including a developing roller carrying a developing material, and causing said developing roller to make contact with an outer surface of said flat surface portion of said photosensitive member to apply said developing material thereto to thereby effect developing; and a support member opposed to an intermediate point between the two adjacent middle developing devices, said support member being laid in parallel to said developing rollers, and held in contact with an inner surface of said photosensitive member;

wherein the distance between a position of contact of said developing rollers of one of the two opposite outer developing devices, with said photosensitive member and a position of contact of said support roller closest to that of said one of said two opposite outer developing devices, with said photosensitive member is substantially equal to the distance between a position of contact of said developing roller of the other one of said two opposite outer developing devices with said photosensitive member and a position of contact of said support roller, adjacent to said other one of said two opposite outer developing devices with said photosensitive member, and said distance is substantially equal to the distance between a position of contact of said support member with said photosensitive member and a position of contact of said developing roller of one, adjacent thereto, of said two middle developing devices with said photosensitive member.

2. A color image-forming apparatus comprising:

an endless belt-like photosensitive member stretched between and wound around a plurality of support rollers;

a plurality of developing devices spaced at equal intervals from one another along a flat surface portion of said photosensitive member extending between said support rollers, said plurality of developing devices including two opposite outer developing devices, each of said developing devices including a developing roller carrying a developing material, and causing said developing roller to make contact with an outer surface of said flat surface portion of said photosensitive member to apply said developing material thereto to thereby effect developing; and a plurality of support members each opposed to an intermediate point between each of adjacent ones of said developing devices, said support members being laid in parallel with said support rollers, and held in contact with an inner surface of said photosensitive member; and two outer support members held in contact with the inner surface of said photosensitive member, one of said two outer support members being located between a position of contact of said developing roller of one of said two opposite outer developing devices with said photosensitive member and a position of contact of said support roller, closest to said one of said two opposite outer developing devices, with said photosensitive member whereas the other one of said two outer support members is located between a position of contact of said developing roller of the other one of said two opposite outer developing devices with said photosensitive member and a position of contact of said support roller, closest to said other one of said two opposite outer developing devices, with said photosensitive member, and the distance between the position of contact of said developing roller of each of said two opposite outer developing devices with said photosensitive member and the position of contact of each of said two outer support members, closest to the associated one of said two opposite outer developing devices, with the photosensitive member, being substantially equal to the distance between a position of contact of said developing roller of each of said developing devices, other than said two opposite outer developing devices, with said photosensitive member and a position of contact of a respective one of said plurality of said support members, closest to said associated developing device, with said photosensitive member.

* * * * *